US010029813B2

(12) United States Patent
Lorger et al.

(10) Patent No.: US 10,029,813 B2
(45) Date of Patent: Jul. 24, 2018

(54) AUTOMATED BAG HANDLING

(71) Applicant: OCADO INNOVATION LIMITED, Hatfield (GB)

(72) Inventors: Josef Lorger, Styria (AT); Heimo Gallaun, Styria (AT); Gerold Repnegg, Styria (AT); Wolfgang Kober, Styria (AT); Shahram Montasser, Kettering Northants (GB)

(73) Assignee: OCADO INNOVATION LIMITED, Hatfield, Hertfordshire (GB)

( * ) Notice: Subject to any disclaimer, the term of this patent is extended or adjusted under 35 U.S.C. 154(b) by 537 days.

(21) Appl. No.: 14/443,957

(22) PCT Filed: Nov. 19, 2013

(86) PCT No.: PCT/GB2013/053055
§ 371 (c)(1),
(2) Date: May 19, 2015

(87) PCT Pub. No.: WO2014/076507
PCT Pub. Date: May 22, 2014

(65) Prior Publication Data

US 2015/0291296 A1 Oct. 15, 2015

(30) Foreign Application Priority Data

Nov. 19, 2012 (GB) ..... 1220784.1

(51) Int. Cl.
*B65B 5/04* (2006.01)
*B65B 5/06* (2006.01)
(Continued)

(52) U.S. Cl.
CPC ..... *B65B 43/28* (2013.01); *B65B 5/045* (2013.01); *B65B 5/067* (2013.01); *B65B 5/10* (2013.01);
(Continued)

(58) Field of Classification Search
CPC .... B65B 43/30; B65B 43/465; B65B 67/1255
(Continued)

(56) References Cited

U.S. PATENT DOCUMENTS 3,707,826 A * 1/1973 Cole ..... A47F 9/042 53/384.1
3,869,065 A 5/1975 Wang
(Continued)

FOREIGN PATENT DOCUMENTS

EP 2 447 166 A1 5/2012
FR 2696992 A1 * 4/1994 ..... B65B 67/1227

OTHER PUBLICATIONS

International Search Report (PCT/ISA/210) dated Jul. 7, 2014, by the European Patent Office as the International Searching Authority for International Application No. PCT/GB2013/053055.

*Primary Examiner* — Thanh Truong
*Assistant Examiner* — Patrick Fry
(74) *Attorney, Agent, or Firm* — Buchanan Ingersoll & Rooney PC

(57) ABSTRACT

An apparatus and method for automatically handling vest-type bags in the context of an automated packing process for packing items such as groceries are described. The apparatus includes at least two fingers that extend parallel to one another, and are arranged to move apart to increase the spacing between the fingers along a bag-opening direction. The fingers are inserted between the strips of the handle, and then moved apart in the bag-opening direction to part the strips of the handle in the bag-opening direction. A packing process involving automated bag handling operations is also inclosed.

38 Claims, 9 Drawing Sheets

(51) Int. Cl.
*B65B 5/10* (2006.01)
*B65B 43/28* (2006.01)
*B65B 43/30* (2006.01)
*B65B 43/46* (2006.01)

(52) U.S. Cl.
CPC ..... *B65B 5/108* (2013.01); *B65B 43/30* (2013.01); *B65B 43/465* (2013.01)

(58) Field of Classification Search
USPC ..... 53/459, 492, 570, 386.1; 211/12; 493/212
See application file for complete search history.

(56) References Cited

U.S. PATENT DOCUMENTS 4,020,618 A * 5/1977 Benzon-Petersen .... B65B 43/14 186/66
4,199,122 A * 4/1980 Christie ..... B65B 67/1227 248/97
4,512,540 A * 4/1985 Stroh ..... B65B 67/1266 186/61
4,576,388 A * 3/1986 Pope ..... B62B 3/1464 248/100
4,687,462 A * 8/1987 Rewitzer ..... B65B 43/26 493/100
4,726,170 A * 2/1988 Sawa ..... B65B 43/30 53/386.1
4,869,045 A * 9/1989 d'Estaintot ..... B65B 43/12 53/384.1
5,167,301 A * 12/1992 Cappi ..... A47F 9/043 186/66
5,232,186 A * 8/1993 Corkery ..... B65B 67/1227 211/12
5,335,485 A * 8/1994 Cappi ..... A47F 9/043 186/66
6,006,495 A * 12/1999 Varichon ..... A47F 9/043 271/10.06
6,402,098 B2 * 6/2002 Rosky ..... B65B 67/1227 248/175
2004/0055250 A1 * 3/2004 Main ..... B65B 43/18 53/386.1
2008/0098697 A1 5/2008 Murray
2012/0096815 A1 4/2012 Vollenkemper
2016/0288938 A1 * 10/2016 Roytman ..... B65B 43/30

* cited by examiner

AUTOMATED BAG HANDLING

FIELD OF THE INVENTION

The present invention relates to an automated apparatus for handling bags. In particular, but not exclusively the invention relates to an apparatus for opening and placing plastic vest-type bags as part of an industrial-scale, automated goods handling operation, such as a grocery packing operation. The invention also relates to an associated automated method of handling such bags and to a packing process involving automated bag handling.

BACKGROUND TO THE INVENTION

Picking-and-packing processes, in which ordered goods are retrieved from a storage location in a storage facility or warehouse and packed into a container for delivery to a customer, are commonplace in many industries. In particular, the online grocery retail sector is rapidly growing and is becoming increasingly reliant on automation of parts of the process to increase efficiency and to achieve the desired throughput of orders.

A typical online grocery order will include a large number of different products, each with differing shape, size, weight, fragility and perishability. These products must be packed carefully into suitable packaging for delivery to customers. It is convenient to use vest-type carrier bags made from plastics film material for this purpose, because such bags are low-cost and space efficient and are suitable for holding almost all of the different products in a typical grocery order. Furthermore, bags of this type have integral handles which not only facilitate convenient carrying of the filled bags as part of a delivery to a customer, for example, but also enable the bags to be securely placed and held within a container, for picking and packing of products in an order picking system.

During the preparation of the order, it is often necessary or advantageous to ensure that the bags are held open in a predetermined location on a production line arrangement to facilitate the placing or dropping of items into these bags. For example, this location can be inside a container, such as a rigid-walled box or crate, known in the art as a tote, that can be transported between sites within a warehouse on conveyor belts or by other means within a warehouse, and loaded onto a van for delivery to customers. Alternatively, bags can be held open on static racks in picking locations where product may be added, or on a conveyor arrangement that moves the bags through one or multiple picking locations.

While the opening, filling and sealing of plastic bags as part of a packaging process for bulk goods is a well-established technology, the handling of plastic vest-type plastic carrier bags with handles in an automated system is not well-known. In particular, significant challenges are presented when attempting to apply known technology to the automatic handling of bags of this type in a high-throughput industrial-scale process of the type desired to increase the efficiency of online grocery retail operations. One particular challenge is the weak structural integrity of plastics vest-type carrier bags which makes reliable automated manipulation technically difficult.

Against this background, it would be desirable to provide apparatus capable of handling, opening and placing bags, in particular vest-type carrier bags, in an automated system suitable for high-throughput industrial-scale use.

SUMMARY OF THE INVENTION

The present innovations describe some of the components for an automatic device for the opening and placing of vest-type bags in a way which keeps them securely open in a predetermined position for subsequent filling.

According to a first aspect of the present invention, there is provided an apparatus for automatically handling vest-type bags in the context of an automated packing process, the bags having at least one handle in the form of a loop comprising two strips joined at one end of the handle, and the apparatus comprising at least two fingers extending parallel to one another, the fingers being arranged to move apart to increase the spacing between the fingers along a bag-opening direction; wherein the apparatus is arranged to insert the fingers between the strips of the handle, and to move the fingers apart in the bag-opening direction to part the strips of the handle in the bag-opening direction.

In preferred examples of the invention, the apparatus is used in the context of an automated process for packing items such as groceries, but the invention is not limited in this respect.

In preferred embodiments of the invention, the apparatus is configured to manipulate vest-type bags comprising two sheets of film-like material and having a non-rigid form. Such bags are commonly found in supermarkets for packing and transporting groceries etc.

Advantageously, the apparatus may be configured to impart a temporary rigidity to the opened bag to enable its automated manipulation. The temporary rigidity imparted to the bag enables it to be manipulated as though it was a more conventional rigid packaging. It allows for the bag to be placed within a container, such as a tote, which acts as a frame for the non-rigid bag and enables the rigidity to be retained until such time as the bag has been filled with goods, which then themselves provide a structure about which the bag will be supported and will not collapse.

Expressed in other terms, therefore, the present invention provides an apparatus for manipulating bags comprised of two sheets of film-like material and having a non-rigid form, the apparatus comprising at least two fingers extending parallel to one another and movement means for moving the fingers, wherein the movement means is arranged to insert the fingers between the two sheets and to move the fingers into a position and orientation which imparts a temporary rigidity to the bag to enable its automated manipulation.

The apparatus may advantageously comprise suction means for engaging each strip of the handle. The suction means may be configured to grip each strip of the handle so as to part the strips before the fingers are inserted.

The apparatus is preferably configured to insert the fingers when the bag is in a closed configuration where the two sheets are substantially adjacent each other and the bag is unable to receive items, and to separate the fingers to place the bag in an open configuration where the two sheets are substantially separated and the bag is open to receive items.

Movement of the fingers in the bag opening direction provides a first plane of rigidity. The apparatus may be further configured to change the orientation of the fingers to provide a second plane of rigidity different to that of the first plane of rigidity. This greatly enhances the temporary rigidity of the bag to make subsequent automated manipulation of the bag by the apparatus more reliable.

Accordingly, in preferred embodiments of the invention, the fingers are moveable between a first position in which the fingers are inserted into the handle, and a second position in which the fingers pull the loop of the handle outwards from the bag. The first position is preferably substantially perpendicular to the second position. Both the first position and the second position are preferably substantially perpendicular to the bag opening direction, or are in a plane that is substantially perpendicular to the bag opening direction. In preferred embodiments of the invention, the first position is a generally horizontal position, and the second position is a generally vertical position. The fingers are preferably pivotable between the first and second positions about an axis that extends substantially parallel to the bag opening direction.

The apparatus may comprise a carriage having a pivotable part to which the fingers are mounted. The carriage may further comprise a roller connected to the pivotable part and co-operable with a cam track of a guide component of the apparatus, the cam track being arranged such that movement of the carriage along the guide component causes pivoting of the fingers from the first position to the second position.

The apparatus may further be configured to lower the bag towards a container by downward motion of the fingers. Advantageously, movement of the fingers from the first position to the second position may be driven by this downward motion.

Where the orientation of the fingers has been changed, e.g. when the fingers are moved from the first position to the second position, small regions of non-rigidity can subsequently arise in the structure of the bag. Preferably, the apparatus is arranged to provide further means for engaging the bag to provide a temporary rigid structure at the small regions of non-rigidity. The engaging means may conveniently take the form of a push plate which can be moved to be adjacent the regions of non-rigidity. This is particularly important in the region of the bag handles and the opening of the bag, where control of the rigidity of the bag is most important in its subsequent handling.

The push plate or other engaging means may be arranged to tension the handle and constrain side portions of the handle in the bag-opening direction. For example, a push plate may be inserted into the loop of a respective handle and moved away from the fingers in a direction substantially perpendicular to the bag-opening direction so as to tension the handle and constrain the side portions in the bag-opening direction. The push plate may be configured to be inserted into the loop of a respective handle and moved away from the fingers when the fingers are in the second position.

Stretching the handle in this way facilitates the subsequent placement of the bag into a container. For example, once the bag has been opened, it may then be placed into a container configured to support the bag in the open configuration. The container may have suitable recesses, such as slots, which may be provided in a rim of the container. The side portions of the bag handles may be inserted into these slots and the slots may be suitably spaced apart on the rim of the container so that the bag is supported inside the container in the open configuration. Stretching the handle by means of the push plates, or otherwise, causes the side portions of the handle to straighten and facilitates their insertion into the recesses of the container.

The bag when in an open configuration may occupy and have a footprint area associated with it. The apparatus is preferably arranged to move the fingers into a position outside of the footprint area to enable placement of the bag into the container and subsequent disengagement of the apparatus from the bag. By having the fingers outside the footprint, the disengagement is made easier. Also, the rigidity provided by the apparatus may be maintained by transfer of the bag to the support provided by the rigid walls of the container.

The apparatus may further comprise a frame having first and second upstanding legs spaced apart to define a bag-receiving zone in between. A first pair of fingers is preferably mounted to the first leg, and a second pair of fingers is preferably mounted to the second leg. The legs may be configured to pivot about respective axes that extend substantially parallel to the bag-opening direction so as to move the legs inwardly and outwardly with respect to the bag. The inward movement of the legs preferably causes the respective pairs of fingers each to be inserted between the strips of a respective handle of the bag.

Within the same inventive concept there is also provided a packing line for packing items into vest-type bags, the packing line comprising the automated bag-handling apparatus described above. Further, the present invention extends to a packing facility, for example a warehouse or other such order picking and packing facility, comprising such a packing line. For example, the bag-handling apparatus may be employed to open bags automatically and optionally to place the opened bags into totes or other such containers that support and retain the bags in the open configuration. The totes may then be moved along the packing line to packing stations where items, such as groceries for example, may be placed inside the bags in order to fulfil customer orders.

According to a second aspect of the present invention, there is provided an automated method of handling vest-type bags in the context of an automated packing process, the bags having at least one handle in the form of a loop comprising two strips joined at one end of the handle, and the method comprising: inserting at least two fingers of an automated bag-handling apparatus between the strips of the handle, and moving the fingers apart in the bag-opening direction to part the strips of the handle in the bag-opening direction.

The method may advantageously comprise parting the strips of the handle by means of suction before the fingers are inserted between the strips.

The method preferably involves imparting temporary rigidity to the opened bag by means of the fingers to enable automated manipulation of the bag.

The method may comprise moving the fingers from a first position to a second position so as to pull the loop of the handle outwards from the bag. The first position may be substantially perpendicular to the second position. In preferred embodiments of the invention the first position is a generally horizontal position, and the second position is a generally vertical position.

The method may comprise turning the fingers about an axis that extends substantially parallel to the bag opening direction in order to move the fingers between the first and second positions The method may comprise lowering the open bag into a container by moving the fingers in a downwards direction. The downward motion of the fingers may drive the movement of the fingers from the first to the second position via a cam mechanism.

The method may further comprise pulling the handle taut and constraining side portions of the handle in the bag-opening direction.

The method may comprise inserting a push plate into the loop of the handle and moving the push plate away from the fingers in a direction substantially perpendicular to the bag-opening direction. This serves to pull the handle taut and constrain the side portions of the handle in the bag-opening direction. The method may involve inserting the push plate into the loop of the respective handle when the fingers are in the second position.

The method may comprise placing the open bag in a container configured to support the bag in an open configuration. The method may further comprise inserting the constrained side portions of the at least one handle into respective recesses defined in the container. The method may comprise releasing the bag from the handling apparatus by moving the fingers together and moving the fingers further in a downwards direction.

The method may comprise supporting the bag in a bag-receiving zone defined between first and second pairs of fingers and moving the fingers inwardly with respect to the bag so as to insert the respective pairs of fingers between the strips of a respective handle of the bag.

The inventive concept includes a method of packing items such as groceries into vest-type bags, the method comprising automatically handling vest-type bags in accordance with the above method. The invention also provides a packing facility in which items such as groceries are packed into vest-type bags in accordance with the packing method.

According to a third aspect of the present invention, there is provided a method of packing items such as groceries into vest-type bags, the method comprising:

(a) providing an automated bag handling apparatus;
(b) continuously supplying vest-type bags to the automated bag handling apparatus, the bags being supplied empty and in a closed configuration; and
(c) successively supplying containers to the automated bag handling apparatus the containers being adapted to support the vest-type bags in an open configuration;

wherein the automated bag handling apparatus is configured to perform the following operations on each bag in turn:

(i) automatically open the bag; and
(ii) automatically place the opened bag in a container such that the container supports the bag in an open configuration;

the method further comprising:

(d) moving the container including the supported opened bag to a packing station or between a plurality of packing stations;
(e) adding one or more items to the opened bag at the or each packing station whilst the bag is supported inside the container; and
(f) removing the bag containing the one or more items from the container.

The method may comprise automatically placing a plurality of bags into the same container before step (d).

Preferably step (a) of the method comprises providing an automated bag handling apparatus as described above in relation to the first aspect of the present invention. However, other bag handling apparatuses may instead be used in the otherwise novel and inventive method.

Preferably the automated bag handling apparatus is configured to perform operations (i) and (ii) in accordance with the method of the second aspect of the present invention. However, other bag handling techniques may instead be used in the otherwise novel and inventive method.

It should be appreciated that optional features described above in relation to any particular aspect of the invention are equally applicable to the other aspects of the invention.

BRIEF DESCRIPTION OF THE DRAWINGS

Embodiments of the invention will now be described, by way of example only, with reference to the accompanying drawings in which.

DETAILED DESCRIPTION OF EMBODIMENTS OF THE INVENTION

Figure 1:
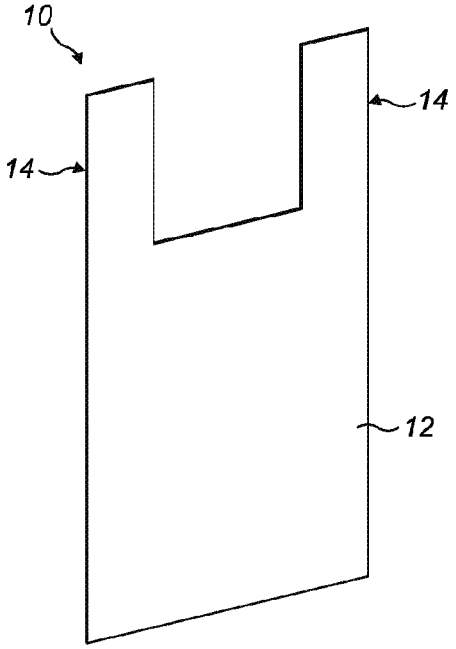
FIG. 1 is a schematic illustration of a vest-type carrier bag.

FIG. 1 shows an example of a vest-type carrier bag 10. The bag 10 is made from two thin layers of plastics film. In a generally rectangular body portion 12 of the bag, the layers are joined along two opposite sides and the bottom of the body portion 12 and are not joined along the top of the body portion 12, to define an open-topped volume for receiving and holding goods when the film layers are spaced apart in use. Two handles 14, one on each side, extend away from the open top of the body portion 12. Each handle 14 is formed by joining the film layers only along their top edge, allowing the film layers to be parted so that the handles 14 form loops.

In the present embodiment, vest-type bags 10 of the type shown in FIG. 1 are supplied flat on a roll for use in an automated, industrial-scale process forming part of a system for fulfilling orders in a grocery retail operation. The present embodiment provides apparatus for opening the bag 10 by separating the two layers of film that form each handle 14, and pulling the layers apart to open the body portion 12 of the bag 10. The apparatus also places the opened bag 10 in a container or tote to allow subsequent filling of the bag to satisfy a customer order.

Figure 2A:
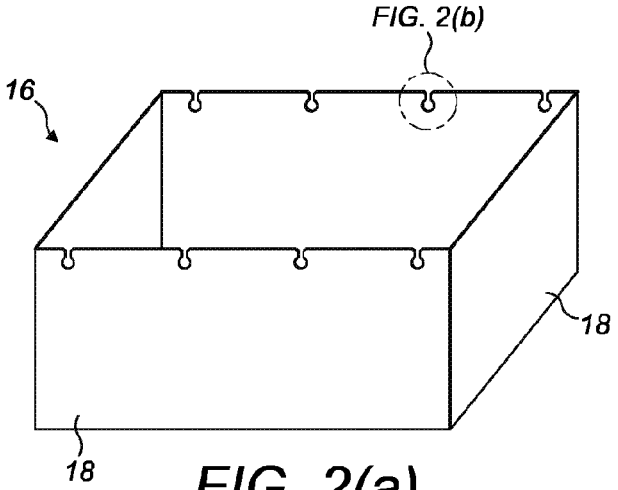
FIGS. 2(*a*) and 2(*b*) provide a schematic illustration of a container or tote for holding bags of the type shown in FIG. 1.
Figure 2B:
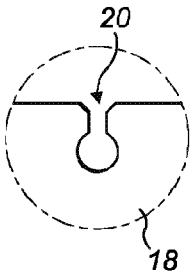

The benefit of using a vest-type bag 10 is that not only can it subsequently be used for carrying the bag as part of the delivery to the customer, but also that it allows the bag 10 to be securely placed and held in a container and thus facilitate the picking and packing of product in an order picking system. FIG. 2(*a*) shows an example of an order picking container 16, known as a tote, having an open top and rigid side walls 18 and base. This type of container 16 is instrumental for moving goods around in a large order picking operation, since the containers 16 can be transported on automated conveyor systems and the like. The container 16 may be equipped with keyhole-shaped slits 20 at the top of the side walls 18 for holding each bag 10 open and in place within the container 16. FIG. 2(*b*) shows the detail of a slit 20.

The present embodiment includes a device for inserting vest-type bags 10 of the type shown in FIG. 1 into containers 16 of the type shown in FIG. 2(*a*), by means of mechanical fingers 22, as will be explained with reference first to FIGS. 3 to 5.

Figure 3:
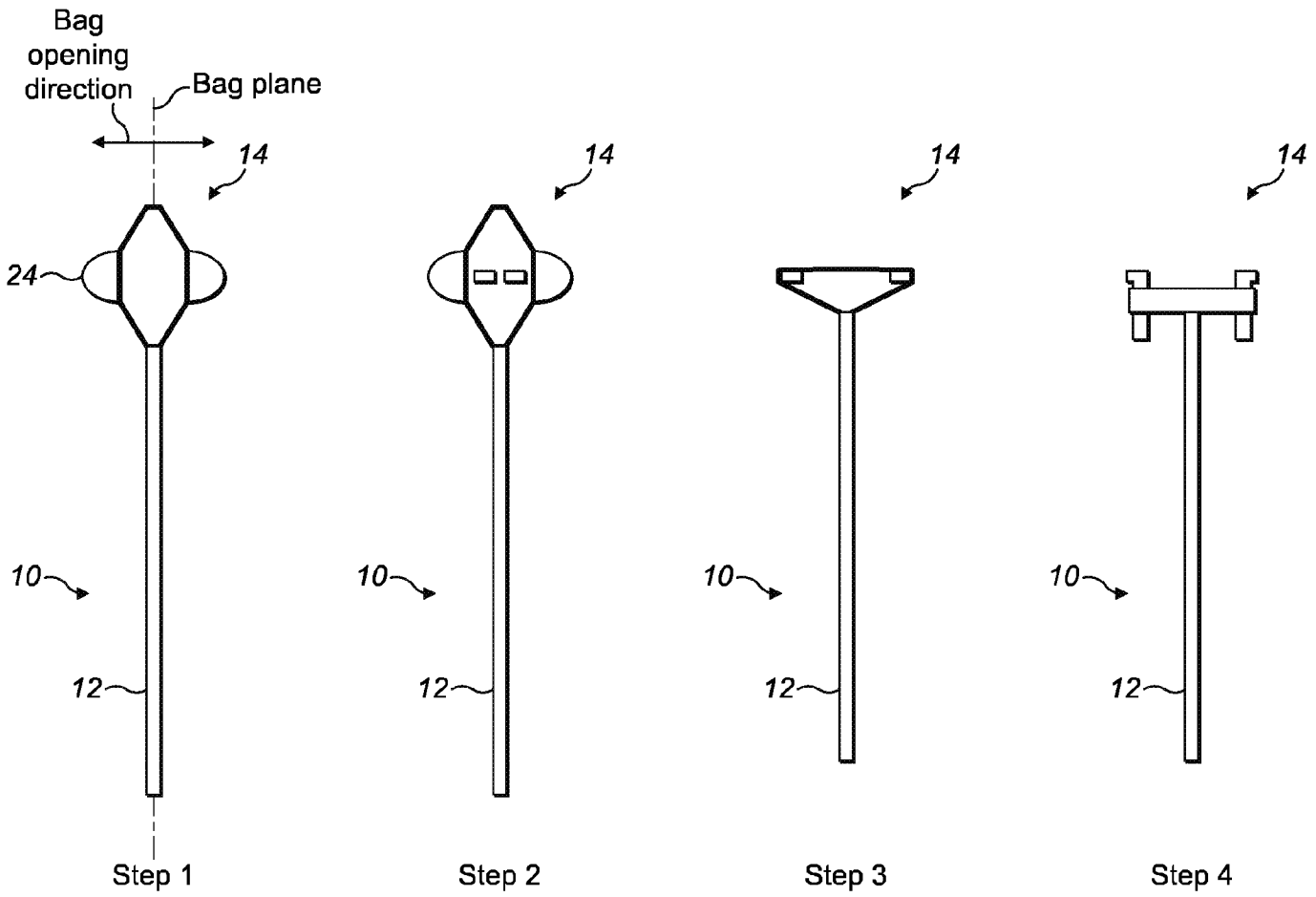
FIGS. 3, 4 and 5 are schematic side, top and front views respectively of a bag handling apparatus according to an embodiment of the invention, illustrating a sequence of steps in a bag opening and placing operation.
Figure 4:
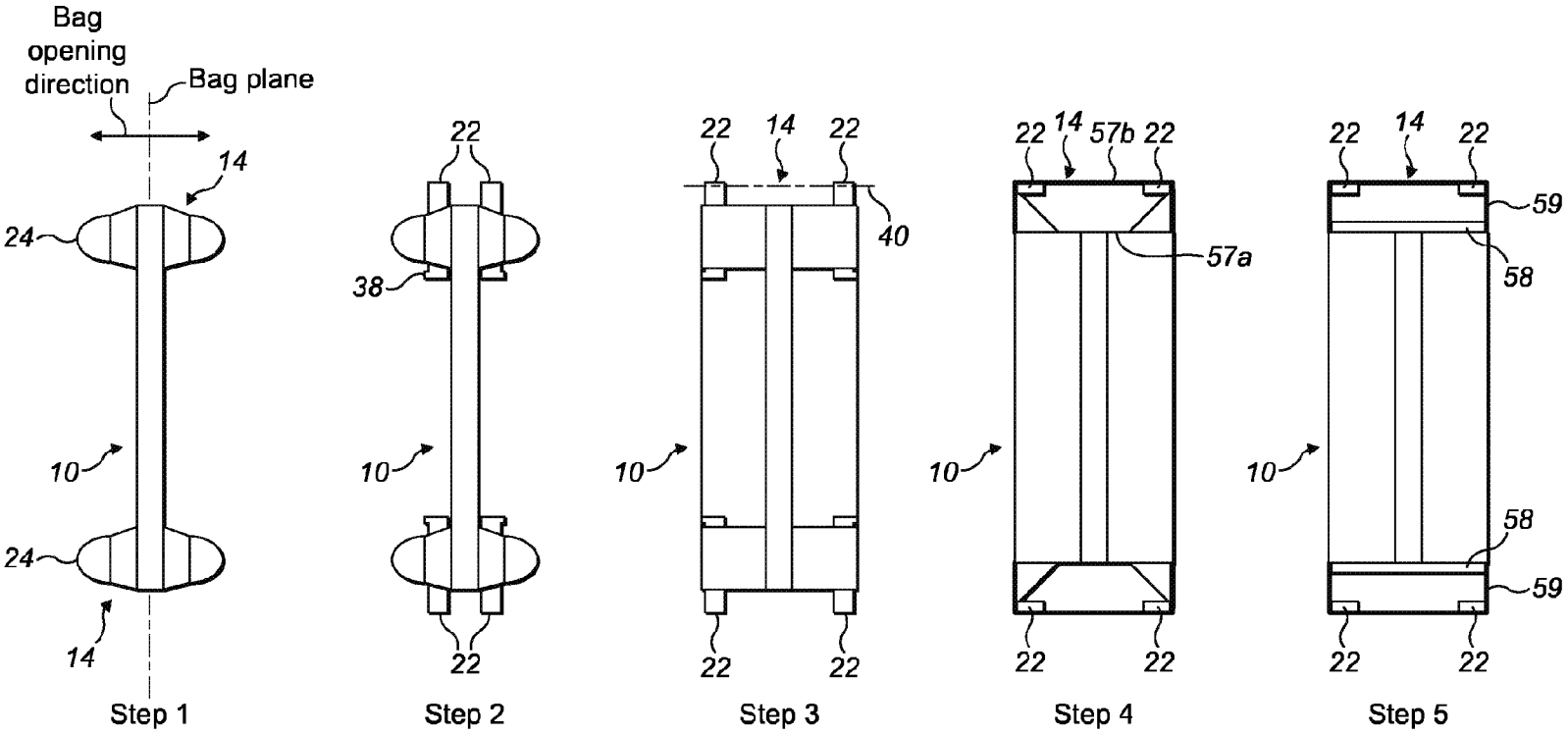
Figure 5:
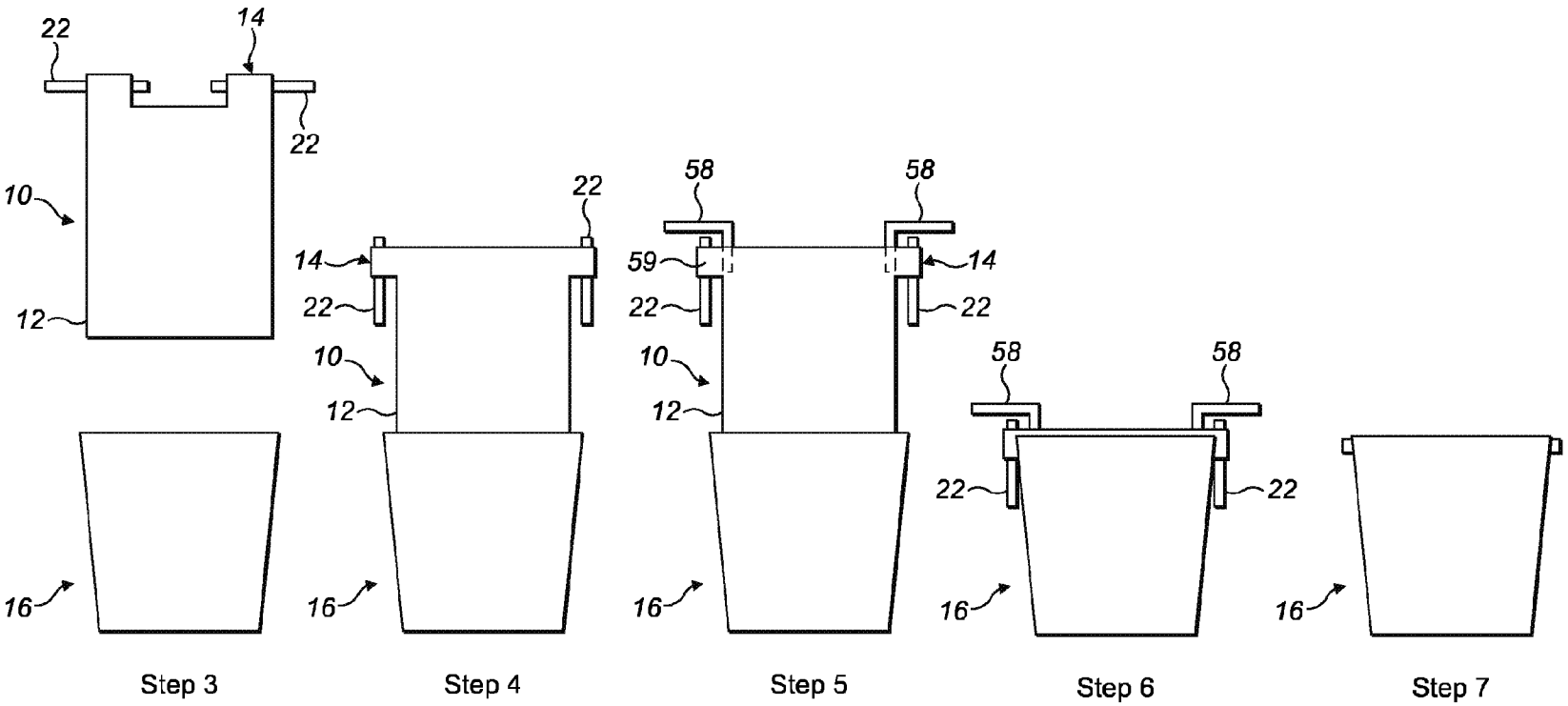

The process starts with one carrier bag 10 being dispensed from a roll into a location in which four suction cups 24 of a suction device are applied to the handles 14 to separate the layers of film in each handle 14, as shown as Step 1 in FIGS. 3 and 4. The bags may alternatively be dispensed from a stack of flat bags provided and for one bag at a time to be dispensed to the apparatus by a bag dispensing mechanism (not shown). The suction cups 24 are arranged either side of a vertical plane, referred to hereafter as the "bag plane". A container or tote 16 is moved into position beneath the bag 10.

The suction cups 24 pull the handles 14 slightly open in a direction perpendicular to the bag plane, known hereafter as the bag opening direction, and the body portion 12 of the bag 10 hangs generally vertically downwards from the handles 14.

Once the handles 14 are opened by the suction device, it is necessary to gain positive mechanical control of the handles 14, in order to open the bags 10 and position them to the intended location.

Figure 6A:
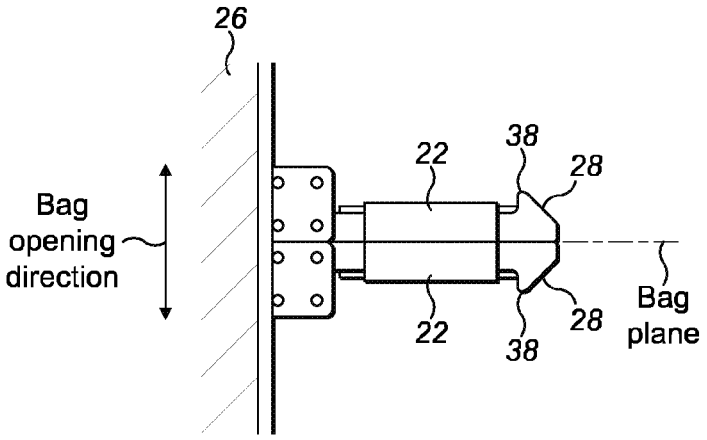
FIGS. 6(*a*) and 6(*b*) are schematic top views of part of a bag opening device of the bag handling apparatus of FIGS. 3 to 5.
Figure 6B:
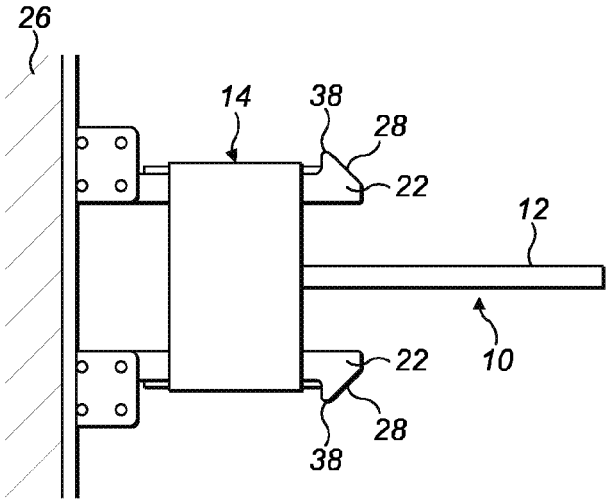

In the present embodiment, this is achieved by means of fingers 22, which are inserted into the opened handle 14 (namely between the two pulled-apart portions of the bag handles) and then moved apart to gain full and positive mechanical control of the bag 10. Referring additionally to FIG. 6(*a*), in one possible embodiment the fingers 22 comprise elongate bar-like members that extend horizontally inwards from a frame 26 in a direction parallel to the bag plane and perpendicular to the bag opening direction. Four fingers 22 are present in total, and the fingers 22 are arranged in two pairs that oppose one another across the frame (only one pair of fingers 22 is shown in FIG. 6(*a*)). The fingers 22 are arranged to slide together and apart from one another in the bag opening direction. The inside end 28 of each finger 22 is shaped so that, when the two fingers 22 of a pair come together as shown in FIG. 6(*b*), they form a pointed shape (pointed in the direction of insertion) for easy insertion between the handles 14 of the bag 10.

As shown in Step 2 in FIGS. 3 and 4, each pair of fingers 22 is inserted into the loop formed by the respective handle 14 of the bag 10. The inward movement of the fingers 22 is achieved by movement of the frame 26, as will now be explained.

Figure 7:
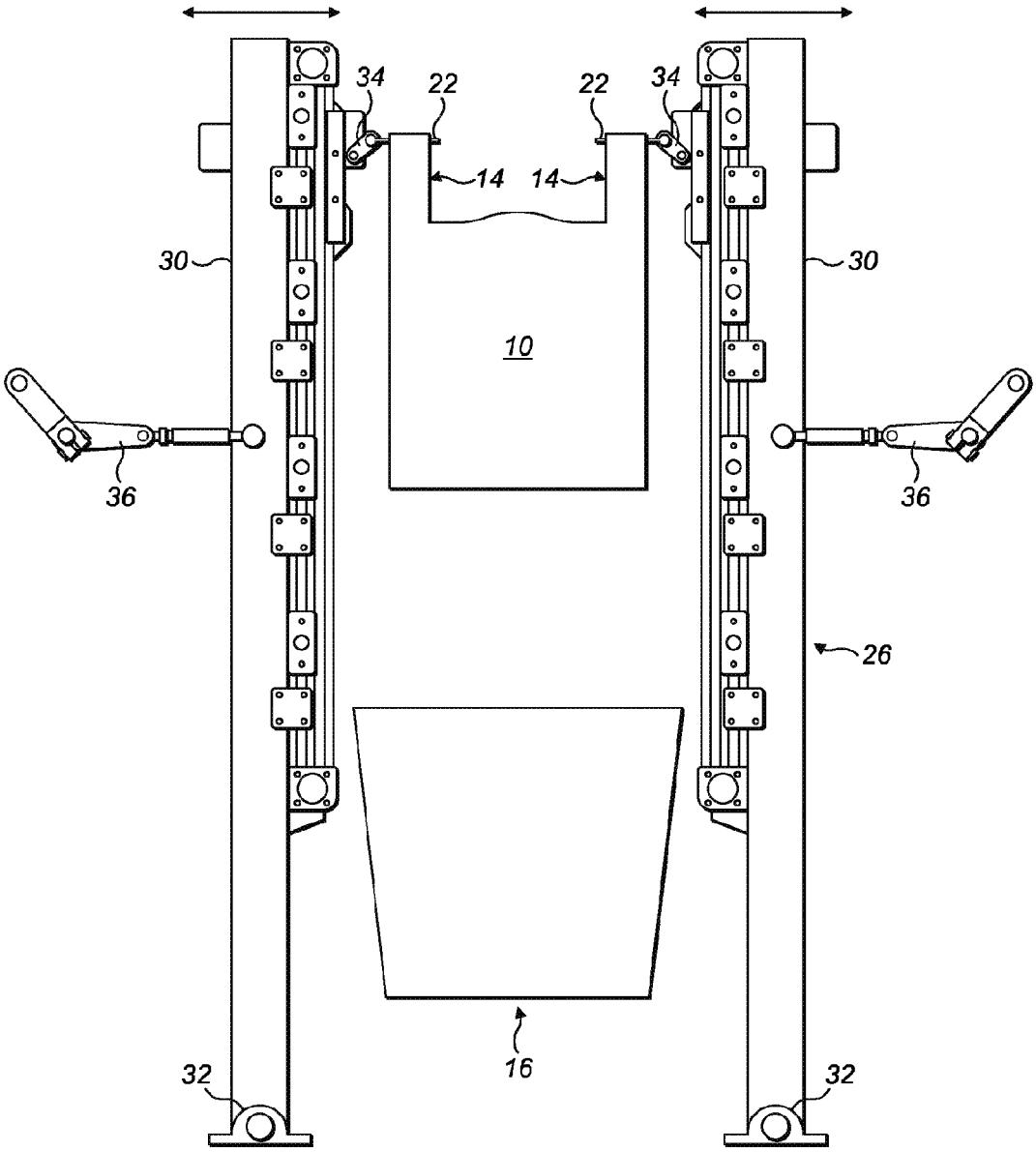
FIG. 7 is a more detailed view of the bag handling apparatus of FIGS. 3 to 5.

FIG. 7 is a front view of the apparatus together with a bag 10 and a container 16, and with the suction device and other features omitted for clarity. The frame 26 comprises upstanding legs 30 that are able to pivot at their respective bases 32 about axes that lie parallel to the bag opening direction and either side of the container 16. The fingers 22 are mounted on carriages 34 that can move up and down in a vertical direction with respect to each leg 30. The legs 30 can be rotated about the pivots in planes parallel to the bag plane (i.e. parallel to the plane of FIG. 7) to move inwardly and outwardly with respect to the bag 10.

When the bag 10 is moved into position, the legs 30 are held in a retracted position, so that the tops of the legs 30 are splayed outwardly (not shown). In Step 2 of the process, the legs 30 are moved inwards by actuators 36 into the position shown in FIG. 7, to push the fingers 22 into the loops of the handles 14. The suction cups 24 are then withdrawn, so that the bag 10 hangs from the fingers 22.

In Step 3, each pair of fingers 22 is separated to stretch the handles 14 open. The fingers 22 move apart in the bag opening direction, into the configuration shown in FIG. 6(*b*). Each finger 22 includes a hook-like formation 38 to help positively locate and retain the bag handle 14 on the finger 22 and to guard against the handle 14 slipping off the fingers 22.

Referring back to FIGS. 3 to 5, In Step 4, the bag 10, held by fingers 22 on both sides, is lowered towards the container 16. As this happens, each pair of fingers 22 is rotated through approximately 90 degrees about a respective pivot axis 40 that extends parallel to the bag opening direction. In this way, the fingers 22 move into a generally vertical or upright configuration.

Figure 8:
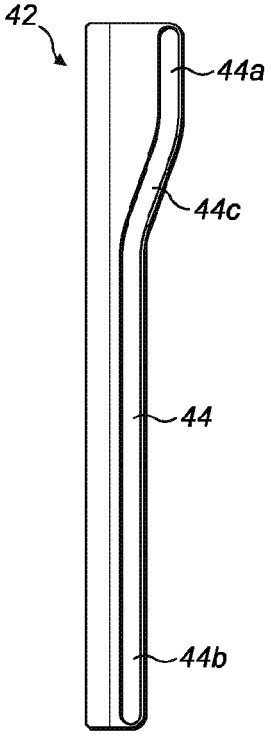
FIG. 8 is a side view of a guide component of the bag handling apparatus of FIGS. 3 to 5.
Figure 9:
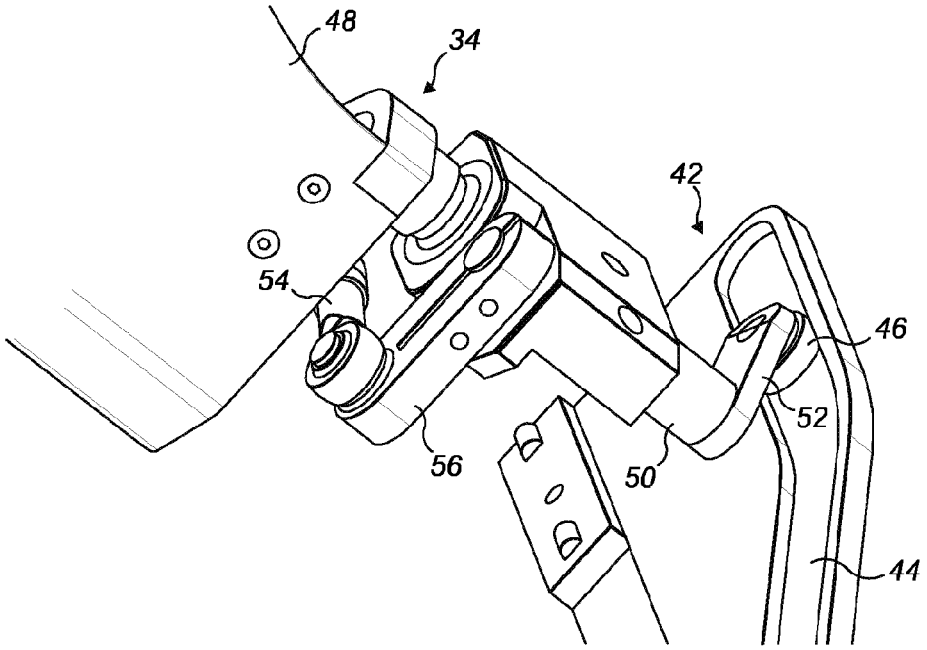
FIG. 9 is a perspective view of part of the bag handling apparatus of FIGS. 3 to 5.

The fingers 22 move into the upright configuration automatically as the carriage 34 moves downwards. Any suitable means can be used to achieve this action. In one embodiment of the invention, movement of the fingers 22 is controlled using a cam mechanism driven by the downwards motion of the carriage 34. An example of a suitable cam mechanism is shown in FIGS. 8 and 9. A guide component 42, shown most clearly in FIG. 8, is positioned vertically along each leg 30 of the frame. The guide component 42 has a cam track 44 for guiding a roller 46 along a path having an upper generally vertical portion 44*a* and a lower generally vertical portion 44*b*. The upper and lower vertical portions 44*a*, 44*b* are linked by an intermediate portion 44*c* of the track 44 that extends at an angle to the vertical. The upper and lower portions 44*a*, 44*b* are offset so that the upper portion 44*a* is closer to the bag 10 than the lower portion 44*b*.

As shown in FIG. 9, the roller 46 engages with the cam track 44. The roller 46 is mounted on the carriage 34, and is connected by links to a plate 48 on which the fingers (not shown in FIG. 9) are mounted. The plate 48 can pivot about an axis that extends in the bag opening direction. The roller 46 is connected to a driveshaft 50 by way of a link 52, so that the driveshaft 50 is driven in a turning movement as the roller 46 moves down the cam track 44. The driveshaft 50 is mounted in a fixed portion of the carriage 34, which is driven in vertical movement by suitable actuators (not shown).

Further links 54, 56 connect the end of the driveshaft 50 opposite the roller 46 to the plate 48, so that turning movement of the driveshaft 50 causes the plate 48 to move from a horizontal orientation to a vertical orientation as the roller 46 moves downwards along the cam track 44. One pair of fingers 22, and the associated mechanism that moves the fingers 22 together and apart, are mounted on and generally parallel to the plate 48, so that the downward movement of the carriage 34 causes the fingers 22 to move into their upright configuration. FIG. 9 shows the cam mechanism used on the left-hand, rear side of the apparatus as oriented in FIG. 7, and the driveshaft 50 moves anticlockwise as the carriage 34 moves downwards to rotate the left-hand pair of fingers 22 to the upright position. A corresponding mirror image cam mechanism (not shown) is also provided on the right-hand rear side of the apparatus of FIG. 7.

Figure 10:
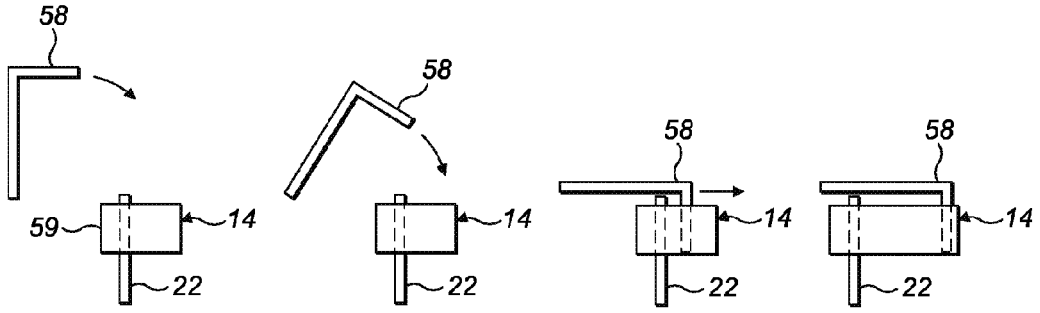
FIG. 10 shows schematic side views of the bag handling apparatus of FIGS. 3 to 5, to illustrate a sequence of further steps in the bag opening and placing operation.
Figure 11:
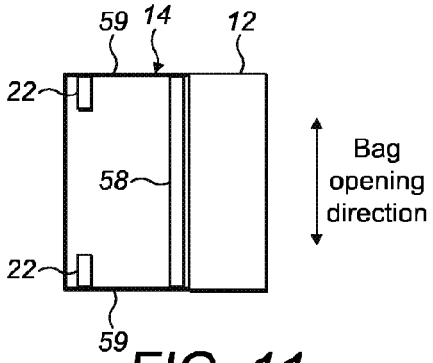
FIG. 11 is a schematic top view of the bag handling apparatus of FIGS. 3 to 5 illustrating one step in the bag opening and placing operation.

Once the fingers 22 have moved into the upright position in Step 4, the handles 14 are then manipulated to stretch them fully open ready to engage with the container 16. This is useful as the rotation of the fingers moves the handles into a position at which one side edge 57*a* of the handle 14 will be relatively taut and the other side edge 57*b* will be relatively slack. So, in Step 5 (see FIGS. 4 and 5), push plates 58 are inserted into the gaps in the handles 14 created by the fingers 22. The push plates 58 are then pushed inwardly towards one another to stretch the handles 14 into a fully open configuration, namely to make the edge 57*a* of the handles 14 which has some relative slack to become taut. Details of the push plate operation 58 are shown in FIGS. 10 and 11, which show the left-hand-side handle 14 of the bag 10. The push plate 58 is a generally rectangular plate which is tilted into a vertical position within the loop of the handle 14 by a suitable mechanism. The handle 14 is held open by the fingers 22 to allow access for the push plate 58. The push plate 58 is then pushed sideways (perpendicular to the bag opening direction) to stretch the handle 14, to ensure both side edges 57 of the handle are relatively taut.

In this position, the plastic film of the handle 14 is fully stretched into a generally rectangular shape and held in a precisely defined position, as shown in the top view of FIG. 11. It will be appreciated that the push plates 58 ensure that side portions 59 of the handles 14 are suitably taut and constrained in the bag-opening direction in order to facilitate their insertion into the slits 20 in the rim of the container 16, as will now be explained.

Figure 12A:
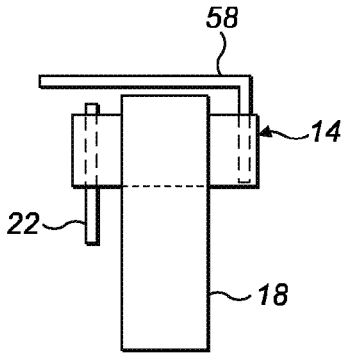
FIGS. 12(*a*) and 12(*b*) are schematic side and top views respectively of the bag handling apparatus of FIGS. 3 to 5, illustrating a further step in the bag opening and placing operation.
Figure 12B:
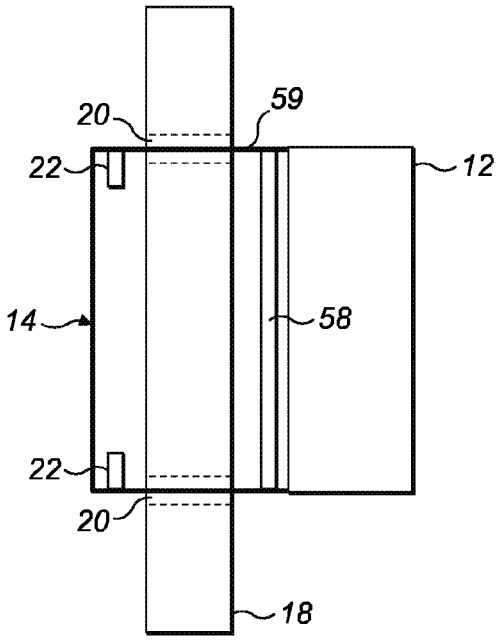

Referring back to FIG. 5, with the bag 10 now fully controlled by the fingers 22 and push plates 58, in Step 6 the bag 10 is lowered into the container 16 in a way which pushes the side portions 59 of the handles 14 into the slits 20, as shown in FIGS. 12(*a*) and 12(*b*). The fingers 22 remain outside the side walls 18 of the container 16, while the push plates 58 are lowered a short distance into the inside of the container 16. In this way, the side portions 59 of the handles 14 are guided into the slits 20 in the rim of the container 16.

In Step 7, when the bag 10 is positioned in the container 16, with the handles 14 engaged with the slits 20 in the container 16, the push plates 58 are lifted and withdrawn and the fingers 22 are moved together in the reverse of the bag opening direction, to disengage the fingers 22 from the handles 14. The fingers 22 are then lowered further to disengage fully the apparatus from the container 16. The bag 10 is now fully inserted into a defined and secure location in the container 16.

In Step 8 of the process (not illustrated), the container 16 is then moved on by means of a conveyor belt, and is replaced by another empty container 16. The legs 30 of the frame are moved outwards and the carriages 34 moved upwards to return the apparatus to its starting position, and the process described above is then repeated to place a bag 10 into the new container 16.

The apparatus may be configured to place multiple bags into each container 16. A first bag 10 is placed at a first location in the container, and the container 16 may then be indexed to another position, to insert a second bag 10 at a second location in the same container. The steps above are then repeated to place further bags in the container. In the present embodiment, four pairs of slits 20 are provided on the rim of the container 16 which permits three bags 10 to be held within the current container 16 as adjacent bags share the same slit in the container. However, the container and the process could readily be designed to hold greater or fewer numbers of bags as required. The automated nature of the bagging process of the present embodiment enables a bagging rate of ten bags per minute to be accurately handled by the apparatus.

The invention claimed is:

1. Apparatus for automatically handling vest-type bags of an automated packing process, the bags including two handles, each handle being formed as a loop with two strips joined at one end of each handle, the apparatus comprising:

two finger pairs, each finger pair being associated with one of the two handles, each finger within the finger pairs extending parallel to one another, said fingers within the finger pairs being arranged to move apart to increase a spacing between the fingers along a bag-opening direction, wherein the apparatus is configured to insert a finger pair between strips of each handle, and to move the fingers apart in the bag-opening direction to part the strips of the handle in the bag-opening direction; and at least one push plate for insertion into a loop of a respective handle, the push plate being moveable away from the fingers in a direction substantially perpendicular to the bag-opening direction so as to tension the handles and constrain the side portions in the bag-opening direction.

2. The apparatus of claim 1, comprising:

suction means configured for engaging each strip of the handle, wherein the suction means is configured to grip each strip of the handle so as to part the strips before the fingers of each finger pair are inserted.

3. The apparatus of claim 1, wherein the apparatus is configured to manipulate vest-type bags having two sheets of film-like material and having a non-rigid form.

4. The apparatus of claim 3, wherein the apparatus is configured to insert the fingers of each finger pair when a bag is in a closed configuration where the two sheets are substantially adjacent each other and the bag is unable to receive items, and to separate the fingers of each finger pair to place the bag in an open configuration where the two sheets are substantially separated and the bag is open to receive items.

5. The apparatus of claim 1, wherein via the at least one push plate for insertion into a loop of a respective handle the apparatus is configured to impart a temporary rigidity to an opened bag to enable automated manipulation of the opened bag.

6. The apparatus of claim 1, wherein the fingers of each finger pair are moveable between a first position in which the fingers of each finger pair are to be inserted into the handle, and a second position in which the fingers of each finger pair will pull the loop of the handle outwards from a respective bag.

7. The apparatus of claim 6, wherein the first position is substantially perpendicular to the second position.

8. The apparatus of claim 6, wherein the first position is a generally horizontal position, and the second position is a generally vertical position.

9. The apparatus of claim 6, wherein the fingers of each finger pair are pivotable between the first and second positions about an axis that extends substantially parallel to the bag opening direction.

10. The apparatus of claim 9, comprising:

a carriage having a pivotable part to which the fingers of each finger pair are mounted.

11. The apparatus of claim 10, wherein the carriage comprises:

a roller connected to the pivotable part and cooperable with a cam track of a guide component of the apparatus, the cam track being arranged such that movement of the carriage along the guide component will cause pivoting of the fingers of each finger pair from the first position to the second position.

12. The apparatus of claim 6, wherein the apparatus is configured to lower the bag towards a container by downward motion of the fingers of each finger pair, with movement of the fingers from the first position to the second position is being driven by the downward motion.

13. The apparatus of claim 6, wherein the at least one push plate is configured to be inserted into the loop of a respective handle and moved away from the fingers when the fingers of each finger pair are in the second position.

14. The apparatus of claim 1, comprising: means for tensioning the handle and constraining side portions of the handle in the bag-opening direction.

15. The apparatus of claim 1, wherein the apparatus is configured to place an open bag in a container configured to support the bag in an opened configuration.

16. The apparatus of claim 15, wherein the apparatus is configured to insert side portions of the at least one handle into respective recesses defined in the container.

17. The apparatus of claim 1, comprising:

a frame having first and second upstanding legs spaced apart to define a bag-receiving zone in between;

a first pair of fingers mounted to the first leg; and a second pair of fingers mounted to the second leg, the legs being configured to pivot about respective axes that extend substantially parallel to the bag-opening direction so as to move the legs inwardly and outwardly with respect to a bag, and wherein inward movement of the legs causes the respective pairs of fingers each to be inserted between the strips of a respective handle of the bag.

18. A packing line for packing items into vest-type bags, the packing line comprising:

the automated bag-handling apparatus of claim 1.

19. A packing facility comprising:

the packing line of claim 18.

20. An automated method of handling vest-type bags in an automated packing process, the bags including two handles formed as a loop with two strips joined at one end of the handle, the method comprising:

inserting a finger pair including two fingers of an automated bag-handling apparatus between the strips of each handle;

moving the fingers within the finger pair apart in a bag-opening direction to part the strips of each handle in the bag-opening direction; and inserting a push plate into the loop of the handles and moving the push plate away from the fingers of each finger pair in a direction substantially perpendicular to the bag-opening direction so as to pull the handles taut and constrain side portions of the handles in the bag-opening direction.

21. The method of claim 20, comprising:

parting the strips of the handle by suction before the fingers of each finger pair are inserted between the strips.

22. The method of claim 20, comprising:

imparting temporary rigidity to an opened bag by means of the fingers of each finger pair to enable automated manipulation of the bag.

23. The method of claim 20 comprising:

moving the fingers of each finger pair from a first position to a second position so as to pull a loop of the respective handle outwards from the bag.

24. The method of claim 23, wherein the first position is substantially perpendicular to the second position.

25. The method of claim 23, wherein the first position is a generally horizontal position, and the second position is a generally vertical position.

26. The method of claim 23, wherein moving the fingers of each finger pair between the first and second positions comprises:

turning the fingers of each finger pair about an axis that extends substantially parallel to the bag opening direction.

27. The method of claim 23, comprising:

lowering an open bag into a container by moving the fingers of each finger pair in a downwards direction, wherein the downward motion of the fingers of each finger pair drives the movement of the fingers of each finger pair from the first to the second position via a cam mechanism.

28. The method of claim 23, comprising:

inserting the push plate into the loop of a respective handle when the fingers of each finger pair are in the second position.

29. The method of claim 20, comprising:

placing the bag in a container configured to support the bag in an opened configuration.

30. The method of claim 29 comprising:

inserting the constrained side portions of the at least one handle into respective recesses defined in the container.

31. The method of claim 29 comprising:

releasing the bag from the handling apparatus by moving the fingers of each finger pair together and moving the fingers further in a downwards direction.

32. The method of claim 20, comprising:

supporting the bag in a bag-receiving zone defined between first and second pairs of fingers and moving the fingers of each finger pair inwardly with respect to the bag so as to insert respective pairs of fingers between the strips of a respective handle of the bag.

33. A method of packing items into vest-type bags, the method comprising:

automatically handling vest-type bags according to the method of claim 20.

34. The method-of claim 33, wherein items are packed into vest-type bags within a packing facility.

35. A method of packing items into vest-type bags, the method comprising:

(a) providing an automated bag handling apparatus, the bag handling apparatus including finger pairs, wherein each finger pair includes two fingers and the fingers of each finger pair are configured to be inserted into a respective handle of the bag;

(b) continuously supplying vest-type bags to the automated bag handling apparatus, the bags being supplied empty and in a closed configuration, each bag including two handles wherein each handle is formed as a loop, the loop includes two strips joined at one end of the respective handle, and the fingers within the finger pairs of the handling apparatus is arranged to move apart in a bag opening direction to part the strips of each handle; and (c) successively supplying containers to the automated bag handling apparatus, the containers being configured to support the vest-type bags in an open configuration;

wherein the automated bag handling apparatus is configured to perform the following operations on each bag in turn:

(i) automatically open the bag; and (ii) automatically place the opened bag in a respective container such that the respective container supports the bag in an open configuration;

the method comprising:

(d) moving the respective container including the supported opened bag to a packing station or between a plurality of packing stations;

(e) adding one or more items to the opened bag at the or each packing station whilst the bag is supported inside the respective container;

(f) removing the bag containing the one or more items from the respective container; and (g) inserting a push plate into the loop of each handle and moving the push plate in a direction substantially perpendicular to the bag-opening direction so as to pull the handles taut and constrain side portions of the handles in the bag-opening direction.

36. The method of claim 35, wherein the automated bag handling apparatus comprises:

inserting the fingers of each finger pair of the automated bag-handling apparatus between the strips of the respective handle; and moving the fingers apart in the bag-opening direction to part the strips of the respective handle in the bag-opening direction.

37. The method of claim 35, wherein the automated bag handling apparatus is configured to perform-operations (i) and (ii) by:

inserting the fingers of each finger pair of the automated bag-handling apparatus between the strips of the respective handle; and moving the fingers apart in the bag-opening direction to part the strips of the respective handle in the bag-opening direction.

38. The method of claim 35, comprising:

automatically placing a plurality of bags into the same container before step (d).

* * * * *